US007638719B2

(12) United States Patent
Pelletier et al.

(10) Patent No.: US 7,638,719 B2
(45) Date of Patent: Dec. 29, 2009

(54) OPERATING ELEMENT

(75) Inventors: Richard Pelletier, Newbury Park, CA (US); Holger Schmidt, Moncalieri (IT); Bernhard Schambeck, Woerthsee (DE); Corona Doering, Munich (DE); Elmar Weiss, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 373 days.

(21) Appl. No.: 11/298,649

(22) Filed: Dec. 12, 2005

(65) Prior Publication Data

US 2006/0144680 A1 Jul. 6, 2006

Related U.S. Application Data

(63) Continuation of application No. PCT/EP2004/005574, filed on May 21, 2004.

(30) Foreign Application Priority Data

Jun. 12, 2003 (DE) ..... 103 26 400

(51) Int. Cl.
*H01H 9/26* (2006.01)

(52) U.S. Cl. ..... 200/5 R; 200/5 E

(58) Field of Classification Search ..... 200/5 R, 200/5 E; 307/10.1, 9.1
See application file for complete search history.

(56) References Cited

U.S. PATENT DOCUMENTS

| | | | | |
|---|---|---|---|---|
| 4,308,439 A | | 12/1981 | Itoh | |
| 5,060,632 A | * | 10/1991 | Hibino et al. | 600/109 |
| 5,229,741 A | * | 7/1993 | Black, III | 338/50 |
| 5,712,460 A | * | 1/1998 | Carr et al. | 200/86.5 |
| 6,008,718 A | | 12/1999 | Chen | |
| 6,657,140 B2 | * | 12/2003 | Rantet | 200/5 R |
| 6,657,316 B1 | * | 12/2003 | Smith et al. | 307/10.1 |
| 6,928,769 B2 | * | 8/2005 | Crawley et al. | 43/107 |
| 7,087,107 B2 | * | 8/2006 | Tateishi et al. | 106/31.49 |
| 2004/0108193 A1 | * | 6/2004 | Schmiz et al. | 200/512 |

FOREIGN PATENT DOCUMENTS

| | | |
|---|---|---|
| DE | 197 56 804 A1 | 7/1998 |
| DE | 200 20 227 U1 | 5/2001 |
| DE | 100 65 853 C1 | 6/2002 |

(Continued)

OTHER PUBLICATIONS

German Search Report with English translation of relevant portion. (Four (4) pages).

(Continued)

*Primary Examiner*—Michael A Friedhofer
*Assistant Examiner*—Lisa N Klaus
(74) *Attorney, Agent, or Firm*—Crowell & Moring LLP

(57) ABSTRACT

An operating element having an operating surface, particularly in a vehicle, for actuating an adjusting device which is in operative connection with a component to be adjusted. The operating surface is constructed as a pressure-sensitive surface. Thus, as a function of the position and/or of the pressure intensity of a pressure exerted on the operating surface, a corresponding adjusting signal can be generated by which the component to be adjusted can be positioned by means of the adjusting device.

20 Claims, 4 Drawing Sheets

FOREIGN PATENT DOCUMENTS

| | | | |
|---|---|---|---|
| DE | 101 26 670 | A1 | 12/2002 |
| DE | 202 12 143 | U1 | 2/2003 |
| DE | 102 36 650 | A1 | 3/2003 |
| EP | 1 111 635 | A2 | 6/2001 |
| WO | WO 00/73982 | A1 | 12/2000 |
| WO | WO 02/01586 | A1 | 1/2002 |

OTHER PUBLICATIONS

International Search Report (Four (4) pages).

* cited by examiner

OPERATING ELEMENT

CROSS-REFERENCE TO RELATED APPLICATIONS

This application is a continuation of PCT Application No. PCT/EP2004/005574 filed on May 21, 2004, which claims priority to German Application No, 103 26 400.0 filed Jun. 12, 2003.

BACKGROUND AND SUMMARY OF THE INVENTION

The invention relates to an operating element having an operating surface for actuating an adjusting device that is in operative connection with a component to be adjusted. The operating element is particularly suitable for use in adjusting a component of a motor vehicle.

As a result of the considerable increase in the number of electronic elements in motor vehicles, the number of operating elements has also increased drastically. The spectrum of operating elements extends from simple switches to complex operating elements. Switches and keys represent the operating elements most frequently used in a motor vehicle. Operating elements, for example, can detect a driver's action or desire. The action desired is provided by the user (e.g., driver) by pressing, pushing or otherwise manipulating an operating element whereby an electric circuit is closed or interrupted. Particular components that are to be adjusted include windows and sliding roofs such as sliding-lifting roofs. Such components, which are operated by means of an adjusting device, require a certain amount of attention during their operation, which may undesirably divert a driver's attention.

Operating elements are preferably integrated into the design of a vehicle as functional elements. The vehicle design therefore frequently has to be adapted to the size of the operating elements and to the related "package." On their path to an "optimal" design, designers require more freedom for shaping arbitrary surfaces. For this purpose, operating elements are desired which can almost invisibly be integrated in existing surfaces.

German Patent No. DE 197 56 804 C2 discloses a pressure-sensitive switch, and particularly a mechanically operated pressure-sensitive switch. In operation, an electric contact or an electric insulation is formed between two opposite electrodes of the switch when, in each case, a force is exercised on one of the electrodes or when a force is neutralized. Specifically, DE 197 56 804 C2 relates to a flat or foil-shaped switch which is arranged in the seat cushion for indicating by means of a binary code (ON or OFF) whether a vehicle occupant is occupying the seat. Thus, in a known manner, the pressure sensitive switch is used only for determining an ON or OFF position. Furthermore, pressure-sensitive flexible switches or foils are generally known, for example, from International Patent No. WO 02/01586 A1 and from U.S. Pat. No. 6,008,718 A.

It is an object of the present invention to improve the operating elements such that they can be operated more easily and intuitively without having to pay special attention to the component to be adjusted during operation. Furthermore, it is possible to integrate the operating elements of the invention more easily and independently with the surface material and with the surface geometry in existing surfaces.

According to a preferred embodiment, an operating element can be adapted to actuate an adjusting device that is in operative connection with a component to be adjusted. Particularly, the operating surface is constructed as a pressure-sensitive operating surface by means of which, as a function of the position and/or the pressure intensity of a pressure exercised on the operating surface, an adjusting signal can be generated such that a component to be adjusted can be correspondingly positioned by way of the adjusting device.

Because the operating surface is constructed as a pressure-sensitive surface wherein pressure can be determined as a function of position, an adjusting signal can be generated in a locally resolved manner such that the component to be adjusted can be moved into its intended position by means of the adjusting device.

Materials in the form of so-called "smart materials" are well suited for use in the pressure sensitive surfaces. These materials are pressure-sensitive and can recognize the position of the pressure as well as the intensity of the pressure. The smart materials may have different constructions. For example, a construction comprising contact foils, which compress under pressure, or a construction comprising a combination of a foamed material and glass fibers is conceivable, as known from International Patent No. WO 00/73982 A1.

As a result of the evaluation of the operating intensity (pressure), more operating possibilities can be obtained. For example, arbitrary positions can be selected directly, and operation on large surfaces is also conceivable. Pressing and sliding movements can be detected and converted to corresponding adjusting signals. Also, greater freedom with respect to design is obtained because arbitrary shapes of pressure-sensitive surfaces can be constructed. These can be combined with arbitrary materials. If required, they can even be designed to be invisible.

According to a preferred embodiment of the invention, the operating surface is constructed as an oblong operating panel having a longitudinal axis that is arranged substantially in the adjusting direction of the component to be adjusted. The oblong operating panel has a first end, which is assigned to a first position of the component to be adjusted, and a second end, which is assigned to a second position of the component to be adjusted. Areas of the operating panel situated between the ends are assigned to corresponding intermediate positions of the component to be adjusted.

This design of the operating surface permits an operation analogous to the function or moving direction of the component to be adjusted. An intuitive operation can take place by a corresponding stroking movement over the corresponding operating panel. However, it also becomes possible to trigger certain situations by means of a touch. Thus, for example, the opening width of a sliding roof or a window can be determined by pressure upon a certain point of the oblong operating panel.

According to another preferred embodiment of the invention, the adjusting speed of the component to be adjusted can be a function of the pressure exercised on the operating surface of the pressure-sensitive surface. Thus, for example, the rapid opening or closing of a sliding roof or window can take place by a firm pressure on the operating surface, and the slow opening or closing can take place by a slight pressure on the operating surface.

According to another preferred embodiment, the pressure-sensitive surface of the operating surface is formed using a pressure-sensitive element, which is constructed of a pressure-sensitive material. However, it is also conceivable to construct the pressure-sensitive surface of a flexible material. A pressure-sensitive element made of a pressure-sensitive material can be disposed in front of the flexible material on its interior surface area facing away from the pressure-sensitive surface. Alternatively, for design-related reasons, the pressure sensitive element can be covered by a flexible material, so that the flexible material forms the pressure-sensitive surface for the operator.

According to another preferred embodiment of the invention, when exercising a pressure upon the operating surface, the operating surface can be caused to vibrate inducing a haptic sensory response. These vibrations can increase as the effect upon the operating surface increases. The operator thereby recognizes that he is actually triggering a switching operation. The vibrations can be generated by piezoelectric elements.

In addition to a sliding roof, the component to be adjusted can comprise a window, seat, or any other suitable component.

The operating element can be arranged adjacent to the component to be adjusted, on a multifunction steering wheel, or at another suitable location.

Additional details of the invention are found in the following detailed description and the attached drawings in which preferred embodiments of the invention are illustrated as examples.

DETAILED DESCRIPTION OF THE DRAWINGS

Figure 1:
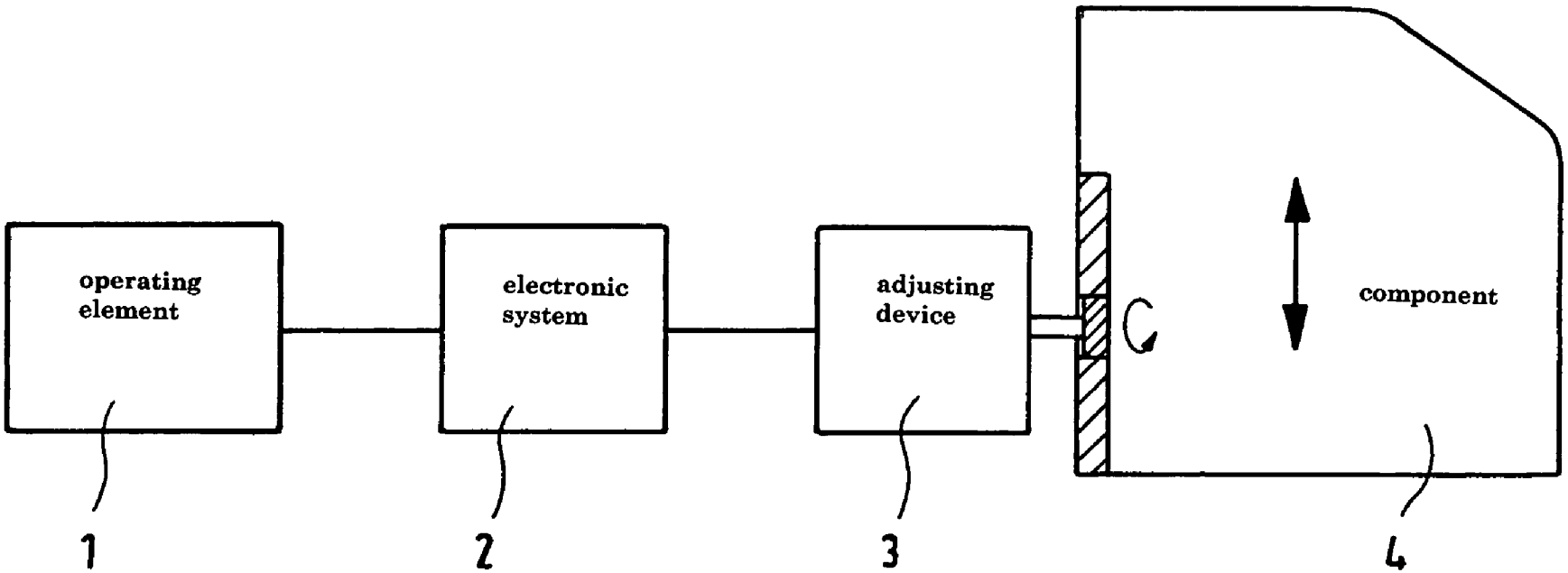
FIG. 1 is a block diagram of an operating element with an adjusting device and a component to be adjusted.

Referring to FIG. 1, an operating element 1 is connected with an adjusting device 3 via an electronic system 2 arranged at an output side of the operating element 1. The adjusting device 3 is adapted to position a component 4 to be adjusted.

Figure 2:
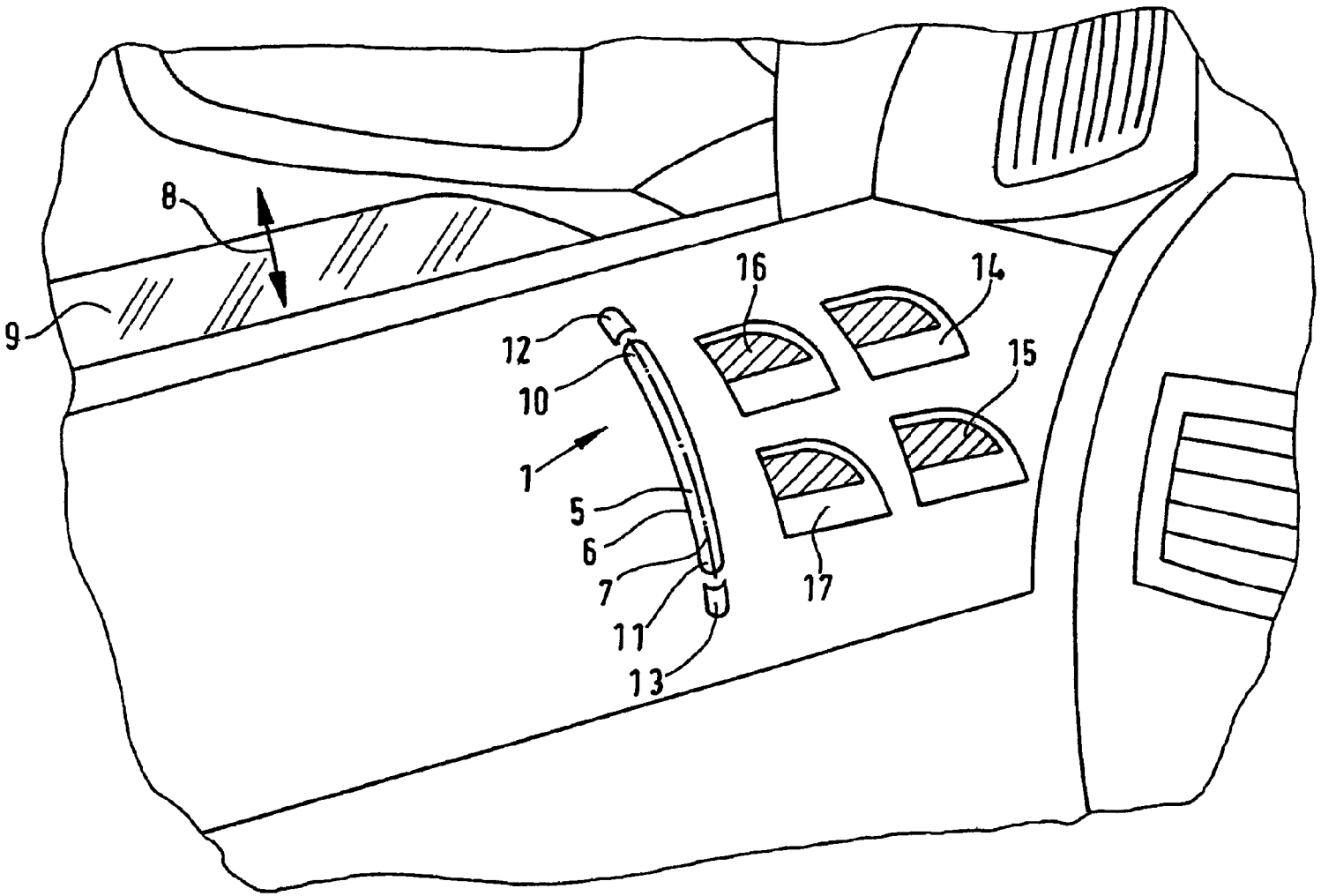
FIG. 2 is a three-dimensional torn-out representation of a motor vehicle interior showing operating elements for adjusting windows, which are arranged in the vehicle door.

As shown in FIG. 2, the operating element 1 has an operating surface 5, which is constructed as a pressure-sensitive surface. The operating surface 5 is constructed of a "smart material" which can detect the position of the pressure exercised upon it as well as the pressure intensity. The pressure exercised by an operator or driver upon the operating surface 5 is analyzed by an electronic system and is transmitted as a corresponding adjusting signal to the adjusting device 3, which correspondingly positions the component 4 to be adjusted.

According to the embodiment of FIG. 2, the operating surface 5 is constructed as an oblong operating panel 6 whose longitudinal axis 7 is arranged approximately in the adjusting direction 8 of the component 4 to be adjusted. The component can comprise, for example, a forward left window 9. The oblong operating panel 6 has a first end 10 which is assigned to a first position, specifically to the closed window 9. The second end 11 of the oblong operating panel 6 facing away from the first end 10 is correspondingly assigned to a second position of the component 4 to be adjusted, specifically to the completely opened window 9. Areas of the operating panel 6 situated between the ends 10, 11 are assigned to corresponding intermediate positions of the window 9.

When a finger of the operator strokes the oblong operating panel 6, the window 9 can be opened or closed intuitively. The rapidity of the opening or closing operation is determined by the intensity of the pressure exercised on the operating panel 6. In the example, one closing panel 12 and one opening panel 13 respectively are disposed in front of the two outer ends 10, 11 of the operating panel 6. By exercising pressure upon the panels 12, 13, a complete closing or opening operation is carried out in a known manner.

The assignment of the operating element 1 or of the operating panel 6 to the individual side windows takes place by way of assignment fields 14, 15, 16, 17. By exercising pressure upon the first assignment field 14, the operating surface 5 is assigned to the forward left window 9. Pressure upon the second assignment field 15 assigns the operating surface 5 to a right side window, which is not shown. Pressure upon the third assignment field 16 causes an assignment to a left rear side window, which is not shown. Pressure upon the fourth assignment field 17 causes an assignment to a right rear side window, which is also not shown.

In principle, instead of the assignment fields 14, 15, 16, 17, three additional oblong operating panels 6 can also be arranged so that a separate operating panel 6 is assigned to each window.

Figure 3:
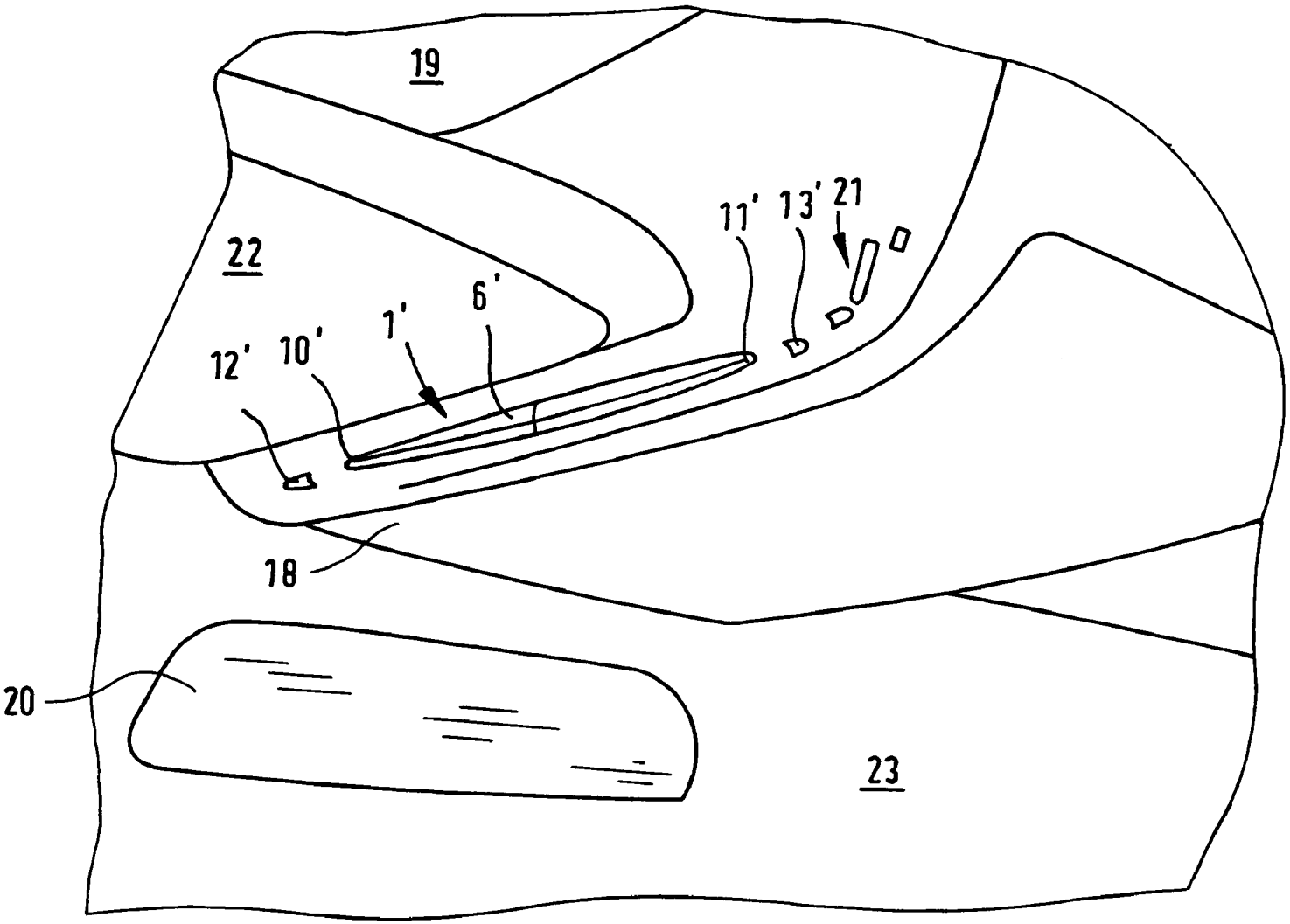
FIG. 3 is a three-dimensional torn-out representation of a motor vehicle interior showing operating elements in the vehicle ceiling area for adjusting a sliding roof.

In a second example according to FIG. 3, the operating element 1' is arranged on an operating panel 18 in the area of a ceiling 19 above an interior mirror 20. The oblong operating panel 6' is arranged on the operating panel 18 for adjusting the position of a roof window, which is not shown. In this case, a closing panel 12' and an opening panel 13', respectively, are disposed in front of the first end 10' and the second end 11' of the oblong operating panel 6'. An operating element 21 is provided on the operating panel 18 for the operation of a vent, which is not shown. A sun shield 22, a front window 23, and an interior mirror 20 are illustrated in FIG. 3 for easier orientation.

Figure 4:
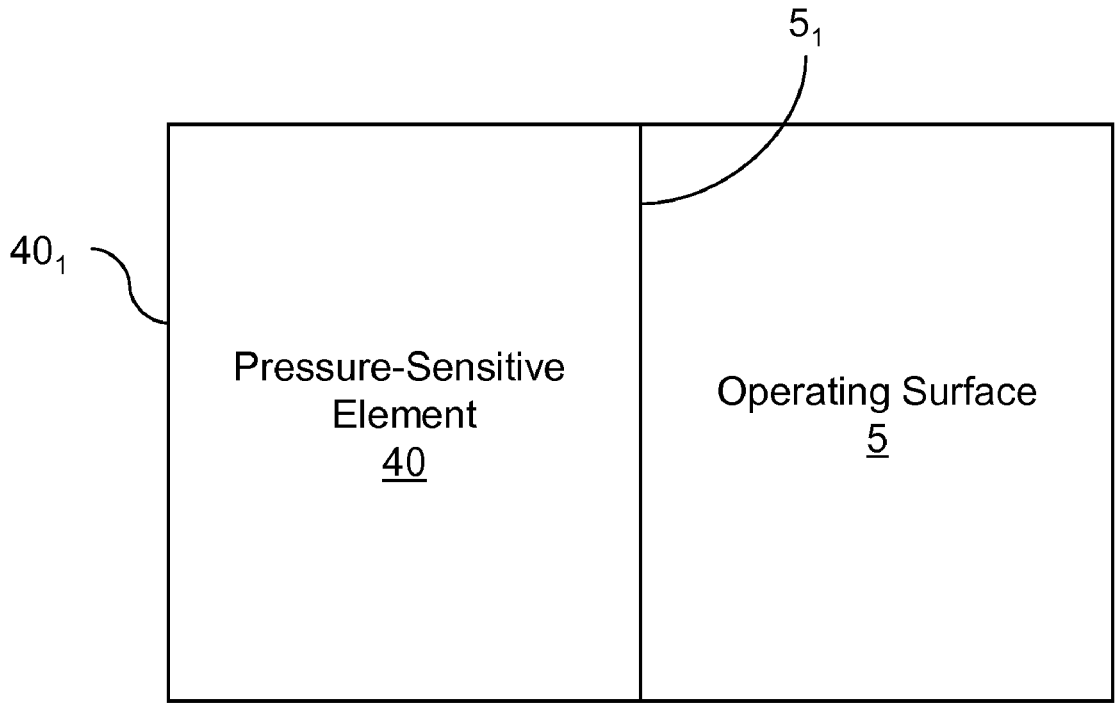
FIG. 4 is a block diagram of an operating surface formed by a flexible material, and a pressure-sensitive element disposed in front of the flexible material on its interior surface area facing away from the operating surface.

FIG. 4 is a block diagram of an operating surface 5 formed by a flexible material, and a pressure-sensitive element 40 disposed in front of the flexible material on interior surface area $\mathbf{5}_1$ facing away from the operating surface 5. Specifically, $\mathbf{40}_1$ is the face of pressure-sensitive element 40, and accordingly, pressure-sensitive element 40 faces away from operating surface 5.

All of the above-mentioned references are herein incorporated by reference in their entirety to the same extent as if each individual reference was specifically and individually indicated to be incorporated herein by reference in its entirety.

While the invention has been described with reference to preferred embodiments, it is to be understood that variations and modifications may be resorted to as will be apparent to those skilled in the art. Such variations and modifications are to be considered within the purview and scope of the invention as defined by the claims appended hereto.

The invention claimed is:

1. An operating element adapted to actuate an adjusting device that is in operative connection with a component to be adjusted, comprising:

a pressure-sensitive operating surface adapted to generate an adjusting signal as a function of a position of a pressure and an intensity of a pressure exercised on the operating surface by which the component to be adjusted is correspondingly positionable by the adjusting device, wherein an adjusting speed of the component to be adjusted is a function of the intensity of the pressure exercised on the operating surface.

2. An operating element adapted to actuate an adjusting device that is in operative connection with a component to be adjusted, comprising:

a pressure-sensitive operating surface adapted to generate an adjusting signal as a function of at least one of a position of a pressure and an intensity of a pressure exercised on the operating surface by which the component to be adjusted is correspondingly positionable by the adjusting device, wherein an adjusting speed of the component to be adjusted is a function of the pressure exercised on the operating surface.

3. The operating element according to claim 2, wherein the operating surface is constructed as an oblong operating panel having a longitudinal axis that is arranged substantially in the adjusting direction of the component to be adjusted, the oblong operating panel having a first end which is assigned to a first position of the component, and a second end which is assigned to a second position of the component, wherein areas of the operating panel situated between the first end and the second end are assigned to corresponding intermediate positions of the component.

4. The operating element according to claim 2, wherein the operating surface is formed by a pressure-sensitive element.

5. The operating element according to claim 4, wherein the pressure-sensitive element is made of a pressure-sensitive material.

6. The operating element according to claim 4, wherein the pressure-sensitive element is invisible to a user.

7. The operating element according to claim 4, wherein the pressure sensitive element is covered by a flexible material such that the flexible material forms the pressure-sensitive surface.

8. The operating element according to claim 2, wherein the operating surface is formed by a flexible material, and a pressure-sensitive element is disposed in front of the flexible material on its interior surface area facing away from the operating surface.

9. The operating element according to claim 2, wherein the operating surface is caused to vibrate when a pressure is exercised on the operating surface.

10. The operating element according to claim 9, wherein the vibration increases in intensity as the pressure exercised on the operating surface is increased.

11. The operating element according to claim 9, wherein vibrations are generated by piezoelectric elements.

12. The operating element according to claim 2, wherein the component to be adjusted is a sliding roof and the operating surface is part of a sliding lifting roof switch.

13. The operating element according to claim 2, wherein the component to be adjusted is a window and the operating surface is part of a window lifter switch.

14. The operating element according to claim 2, wherein the component to be adjusted is a seat and the operating surface is part of a seat adjusting switch.

15. The operating element according to claim 2, wherein the operating surface is arranged on a multifunction steering wheel.

16. The operating element according to claim 2, wherein the degree of the adjustment is a function of the location of the pressure exercised on the operating surface.

17. The operating element according to claim 2, wherein the component is a motor vehicle component.

18. The operating element according to claim 2, wherein the pressure-sensitive operating surface includes:

a first portion with a first end that corresponds to a first position and a second end that corresponds with a second position;

a second portion separated from the first portion and arranged at the first end;

a third portion separated from the first portion and arranged at the second end, wherein pressure exercised on the second portion causes the component to be adjusted into a first component position, pressure exercised on the third portion causes the component to be adjusted into a second component position, and pressure exercised on the first portion causes the component to be adjusted into one of the first component position, the second component position and a position between the first and second component positions.

19. A method of adjusting a component of an automobile using an operating element, the method comprising the acts of:

inducing pressure on a pressure-sensitive operating surface of the operating element;

generating an adjusting signal as a function of at least one of a position of the pressure and an intensity of the pressure on the pressure-sensitive operating surface;

actuating an adjusting device in response to the adjusting signal; and adjusting the position of the component using the adjusting device, wherein an adjusting speed of the component to be adjusted is a function of the intensity of the pressure exercised on the operating surface.

20. The method of claim 19, wherein the pressure comprises a simultaneous pressing and sliding motion over the pressure-sensitive operating surface.

* * * * *

UNITED STATES PATENT AND TRADEMARK OFFICE

CERTIFICATE OF CORRECTION

PATENT NO. : 7,638,719 B2
APPLICATION NO. : 11/298649
DATED : December 29, 2009
INVENTOR(S) : Pelletier et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 580 days.

Signed and Sealed this

Eighteenth Day of January, 2011

David J. Kappos

David J. Kappos
*Director of the United States Patent and Trademark Office*